US005246485A

United States Patent [19]

de Haas et al.

[11] Patent Number: 5,246,485

[45] Date of Patent: Sep. 21, 1993

[54] METHOD AND APPARATUS FOR PREVENTING FUME PRODUCTION WHEN TRANSPORTING MOLTEN METAL FROM A METALLURGICAL VESSEL TO CASTING VESSELS

[75] Inventors: Hans de Haas; Klaus Ulrich; Klaus Grützmacher, all of Bremen; Erhard Krause, Ritterhude; Horstmar Mohnkern, Ritterhude; Manfred Löwenstein, Ritterhude; Manfred Voss, Bremen; Joachim Witt, Ritterhude; Uwe Hammer, Bremen, all of Fed. Rep. of Germany

[73] Assignee: Klöckner Stahl GmbH, Duisburg, Fed. Rep. of Germany

[21] Appl. No.: 768,280

[22] PCT Filed: Dec. 20, 1989

[86] PCT No.: PCT/DE89/00779

§ 371 Date: Oct. 2, 1991

§ 102(e) Date: Oct. 2, 1991

[87] PCT Pub. No.: WO90/08842

PCT Pub. Date: Aug. 9, 1990

[30] Foreign Application Priority Data

| | | | |
|---|---|---|---|
| Feb. 6, 1989 | [DE] | Fed. Rep. of Germany | 3903444 |
| Sep. 4, 1989 | [DE] | Fed. Rep. of Germany | 3929328 |
| Sep. 14, 1989 | [DE] | Fed. Rep. of Germany | 3930729 |
| Oct. 11, 1989 | [DE] | Fed. Rep. of Germany | 3933894 |

[51] Int. Cl.[5] ..... F27D 3/14

[52] U.S. Cl. ..... 75/709; 266/157

[58] Field of Search ..... 75/709; 266/157

[56] References Cited

U.S. PATENT DOCUMENTS

| | | | |
|---|---|---|---|
| 3,439,735 | 4/1969 | Holmes | 164/259 |
| 4,300,753 | 11/1981 | La Bate | 266/196 |
| 4,355,788 | 10/1982 | La Bate | 266/157 |
| 4,357,003 | 11/1982 | Vajda | 266/158 |
| 4,486,230 | 12/1984 | Ball | 75/709 |
| 4,786,250 | 11/1988 | Cooper et al. | 432/95 |

FOREIGN PATENT DOCUMENTS

| | | |
|---|---|---|
| 0071359 | 2/1983 | European Pat. Off. . |
| 856055 | 11/1952 | Fed. Rep. of Germany . |
| 3209648 | 10/1982 | Fed. Rep. of Germany . |
| 2409097 | 6/1979 | France . |
| 747613 | 7/1980 | U.S.S.R. . |
| 2084705 | 4/1982 | United Kingdom . |

OTHER PUBLICATIONS

Kahnwald, "Staubanfall beim Hochofenabstich . . . Staubemissionen" in *Stahl und Eisen,* 104 (1984) No. 7, pp. 351–356.

P. van Ackeren, "Fortschritte in der . . . Hochofen," in Stahl und Eisen, 104 (1984), pp. 551–556.

*Primary Examiner*—Peter D. Rosenberg

*Attorney, Agent, or Firm*—Watson, Cole, Grindle & Watson

[57] ABSTRACT

It is proposed, in the case of at least one transport and discharge runner installed at a tapping orifice of the metallurgical furnace and a transfer station having a swivel or tilting runner in which the molten metal flows from the discharge runner by way of a distribution system into the outlet openings from which it flows into a preferably movable casting vessel, to cover the discharge runners conveying the molten metal from the tapping orifice of the metallurgical furnace with cover hoods, to screen off the transfer station in a substantially gastight manner, to sweep these interiors with inert gas and in addition to screen off the molten metal discharge stream from the outlet opening to the casting vessel by means of a pressurized inert gas covering which prevents air access and is substantally annular in cross-section. By these means, fume production is effectively avoided.

37 Claims, 7 Drawing Sheets

Figure 1:
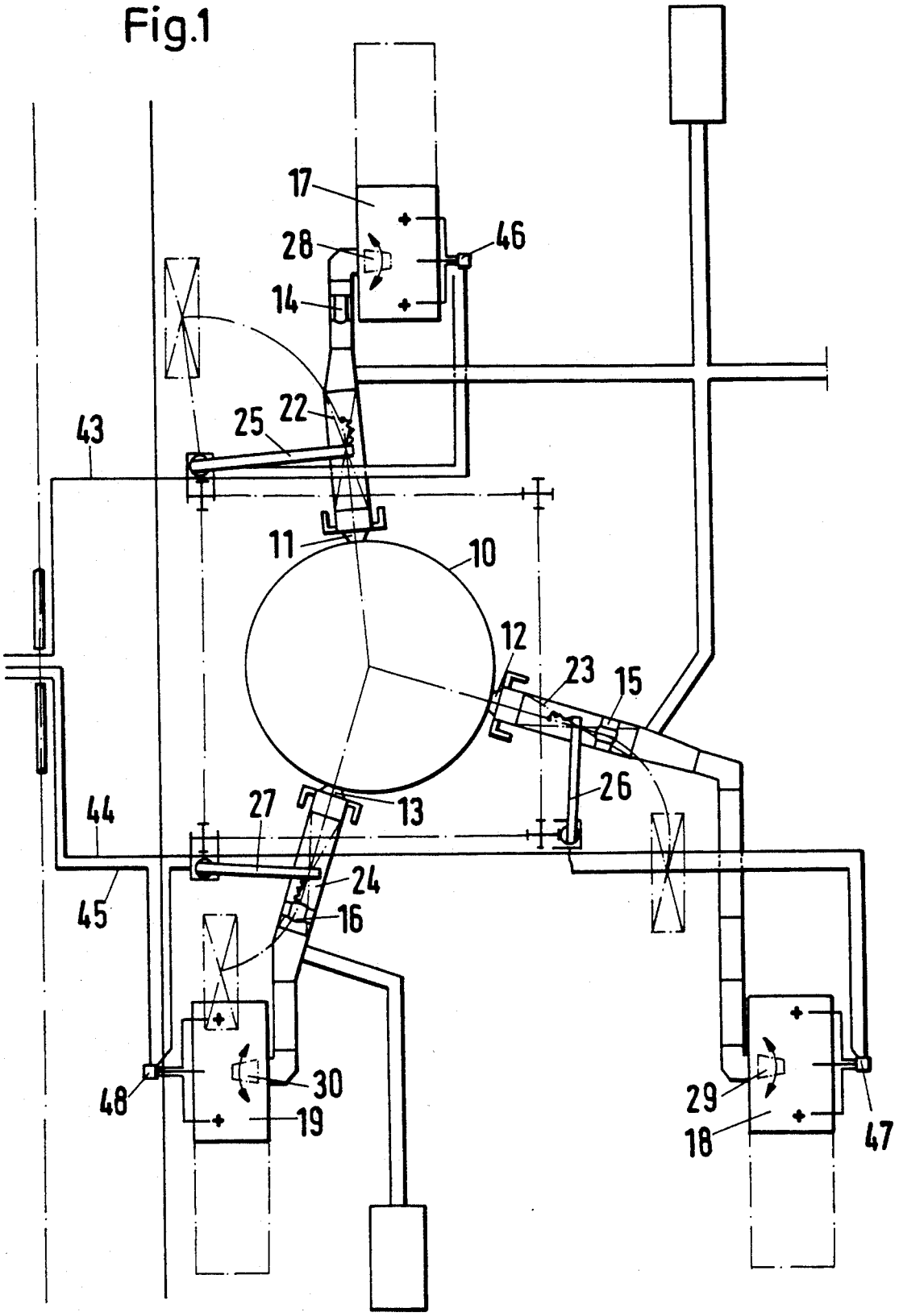

METHOD AND APPARATUS FOR PREVENTING FUME PRODUCTION WHEN TRANSPORTING MOLTEN METAL FROM A METALLURGICAL VESSEL TO CASTING VESSELS

The invention relates to a method of preventing fume production during metallurigcal processes and when transporting molten metal from a metallurgical vessel, in particular a metallurgical furnace such as a blast furnace, to casting vessels. The invention further relates to apparatus which comprises at least one transporting and discharge runner, which is installed at a tapping orifice of a metallurgical furnace, and a transfer station having a swivel or tilting runner in which the molten metal flows from the discharge runner by way of a distribution system into outlet openings from which it runs off into a preferably movable casting vessel.

In metal production, particularly steel and iron manufacture, when i.a. the molten metal is transported considerable quantities of so-called "brown fume", mainly consisting of metal oxides, arise. The quantities of dust which are produced are so high that measures have to be taken to limit or eliminate them. Statutory regulations limit the permitted residual dust content to 50 mg of dust/$Nm^3$. In order to attain these levels, according to the current state of the art (cf. German publications "Outdated plant programme of the Minister of the Interior, clean-air preservation, final report—Dust removal from foundry blast furnaces with smelting outputs of 5000 t/d and 4000 t/d" by Dipl.-Ing. Dieter Eickelpasch, Hoesch Stahl AG, Dortmund, March 1985 and "Dust removal from foundry blast furnace B with automatic minimization of the waste gas quantity" by Dr. Ing. Paul van Ackeren, Mannesmannröhrern-Werke AG, April 1983 and German publication "Steel and Iron" 104 (1984) No. 7, pages 351 ff.), the brown fume arising when iron and steel are transported is passed by means of extensive plant through filters where the iron oxide is separated and collected to be supplied then for appropriate recycling or disposal. To be able to intercept, for example, the dust arising in the tapping bay of a metallurgical furnace, in particular a blast furnace, in the first place requires the setting up of extensive, powerful extraction devices with suitable waste gas filters, pipe systems, ventilating fans, regulating devices and so on which are very expensive both to install and to operate. Furthermore, experience has shown that the extraction process leads to an intensive attraction of air to the flowing pig iron which drastically increases dust formation.

Finally, owing to impurities, not all dusts are suitable for recycling or use elsewhere and so have to be dumped, which contributes towards environmental pollution. As a whole, all the cited measures lead to considerably higher metal extraction costs.

In the past, therefore, measures have already been suggested which reduce the production of dust from the outset. Thus, it has been suggested that molten metal be transported under conditions of simultaneous oxygen displacement which may be created by dosing the flowing metal with nitrogen. In practice, however, attacking the molten metal with nitrogen in open discharge runners without additional measures has proved hardly effective since, as a result of the thermal up-current alone, the entry of oxygen could be limited only to an unsatisfactorily extent. The reduction in, for example, brown fume or in the occurrence of dust was negligible compared to the technical outlay, in particular the inert gas consumption.

For main emission sources which are difficult to access, such as the region of the tapping orifice and the transfer or inlet region into the casting vessels, no fume suppression measures are known. The aim of the present invention is therefore to improve the method and device cited in the introduction in such a manner that, for a low investment and operating cost (energy, maintenance and inert gas consumption), fumes may be extensively suppressed, the invention being specifically targetted at areas which are difficult to control, namely the tapping orifice, the transfer point with, for example, a swivel or tilting runner, the ladle inlet and the casting vessel interior.

This aim is achieved by the measures indicated in claims 1 and 7 which are explained in greater detail hereinafter. Developments of the invention are described in claims 2 to 6 and 8 to 37.

By means of the invention, fume production is advantageously prevented from the outset during each process stage and in each device where the presence of oxygen is not absolutely essential. In particular, not only is the formation of metal oxides (e.g. brown fume) prevented but also, to a wide extent, the oxidation of other substances contained in the molten metal, such as for example sulphur, thereby as far as possible eliminating the production of other undesirable oxides such as, for example, $SO_2$.

There follows a description of the advantages to be derived from the invention when transporting molten metal from a blast furnace to a casting vessel. The same obviously applies to other metallurgical vessels and/or transportation devices uses in steel and iron production.

The term "molten metal" also includes the slag which frequently also arises during metallurgical processes and which can occur in mechanical mixtures or in separate layers together with the molten metal.

Tapping orifice area

As the first measure, it is proposed that the runners located directly at the tapping orifices of the metallurgical furnace, in particular the blast furnace, be covered with, for example, hoods into which an inert gas is introduced. The first result of this is that air is substantially prevented from reaching the molten metal and also by minimizing the interior above the flowing molten metal, the area, in which the metal may theoretically react with the gas lying above it, and thus the scope for potential reaction is substantially reduced.

For processing reasons, the covering hoods must be movable in the region of the tapping orifice, i.e. they must be disposed so as to be capable of being swivelled or tilted away from the discharge runner. The inert gas may be introduced in such a way that it can be used simultaneously to cool areas of high thermal stress.

Transportation

Screening-off of the molten metal stream in the transport runners is achieved in that the runners are covered by hoods, the inert gas introduced being used simultaneously to cool the covering hoods.

Transfer point

Another problem area is the point at which the molten metal is transferred from the transport runner into the inlet opening of the casting vessel. The metal coming from the transport runner, as it descends freely, first encounters a swivel or tilting runner, it preferably flowing off by way of a distributing runner and an outlet opening and by way of this swivel or tilting runner into the casting vessel, e.g. a submarine ladle or a transport vessel. The transfer point is screened off externally in a substantially gas-tight manner by means of a housing, allowing the area inside it to be effectively rendered inert with inert gas, in particular nitrogen. Enclosing the transfer point in a housing substantially minimizes the area to be swept with inert gas. The pressurized introduction of nitrogen or inert gas, otherwise economically untenable, is confined to a small area, namely the area extending from the end of the transport runner to the outlet opening into the casting vessel, e.g. a ladle or a submarine carriage. For processing reasons, the transfer station is fitted with a, preferably movable, cover.

In a special feature of the invention, the swivel or tilting runner is cooled while the molten metal flows through it by the same inert gas used to ensure that the interior formed by the screen is rendered inert. In so doing, the inert gas beneath the screen is preferably blasted against the walls of the swivel or tilting runner. To reduce inert gas consumption, the overpressure above the molten metal stream should be kept to a minimum in the discharge runners, the transfer area and the casting vessel interior.

Discharge into the casting vessel

A covering of inert gas prevents air from reaching the discharge stream of molten metal after it emerges from the outlet opening and until it enters the casting vessel. This covering of inert gas is created by a preferably annular emission of inert gas under pressure, preferably 1.5 bar, producing a veil of inert gas which encloses the molten stream. In principle, it would also be possible to use, instead of the inert gas veil, technically equivalent pipe inlets and mechanical seals. However, use of these is restricted by the fact that there are often skull-like deposits on the inlet openings of casting vessels which make it impossible to fit a pipe onto such an inlet opening in a gastight manner. The only alternative to the enclosing inert gas veil is therefore metal chains, strips or the like but these have the drawback of being displaceable towards one another, making it difficult to create an airtight closure there, particularly owing to the thermal up-current prevailing during casting. In this area too, the inert gas is additionally used as a cooling medium for the outlet opening.

Casting vessel

As a further measure, the casting vessel interior is held substantially under inert gas by introducing inert gas, preferably through inlet openings located in the vessel's walls, in order to prevent metal oxidation there too. The inert gas emerging from the casting vessel's charging opening for the molten metal enhances the described screening effect of the annular inert gas veil on the molten metal stream. The process of rendering the casting vessel inert should preferably begin before the first intake of molten metal.

Inert gases

According to the present invention, as an inert gas either nitrogen may be used or a gas whose free oxygen content has been consumed by burning in a combustion chamber. The inert gas thereby produced, which may be achieved for example by burning natural gas, is cooled before being introduced into the said areas.

Object of the method and apparatus

Assuming that in the casting bay of a blast furnace, for example, using conventional dust extraction methods approximately 1.5 kg of dust/t of molten metal is yielded through suction extraction of the dust arising, then this dust quantity can be reduced using the dust suppression method according to the invention to at least 0.1 kg/t of molten metal. This is lower than the dust quantity which would be achieved using conventional dust extraction in the casting bay; in addition there is the saving to be made on suction extraction of the dust and its subsequent disposal. By avoiding dust production in the first place, the air is kept clean without the need for extraction and expensive after treatment of dust. Other cost-saving side-effects are that energy is no longer required to drive the dust removal equipment and noise is reduced.

The point described earlier when the molten metal is transferred from the transport runner still has a relatively large housing in which a tilting or swivel runner is disposed.

A tilting runner is a runner arrangement in which the pig iron emerging from a discharge runner is conveyed by way of a runner, which is tiltable about a horizontal axis, into various casting vessels.

A swivel runner is a runner arrangement in which the pig iron emerging from a discharge runner is conveyed along a runner, which can be swivelled or rotated about a vertical axis and from which the pig iron is conveyed directly, or by way of a distribution system located thereunder and comprising a plurality of individual runners, into the casting vessels.

Depending on the size of these runner arrangements, relatively large amounts of inert gas such as, for example, nitrogen are still needed to render the interior of the housings in question inert. In order further to minimize this interior and therefore the inert gas requirement, according to a development of the invention the tilting or swivel runners are covered over their respective runner partial lengths, thereby forming a free interior, i.e. one through which molten metal does not flow, which is as small as possible, the tilting or swivel runner having at its end funnel-like outlet openings on whose faces annular high-pressure gas nozzles or high-pressure gas nozzle rings are disposed. In principle, the runner region of the tilting or swivel runner is therefore covered in the same way as the transport or discharge runners. The funnel-like constructions on the ends of the tilting or swivel runners are used to fasten the annular high-pressure gas nozzles or the high-pressure gas nozzle rings for forming an inert gas covering round the molten metal stream flowing off there. Preferably, it is then possible to dispense with further holding devices for the annular nozzle or nozzle ring.

According to a development of the invention, to create a substantially vertical inert gas covering around the discharged molten metal stream, the outlet funnel is disposed at the angle of inclination or tilt of the tilting or swivel runner, with the result that the diameter of the inert gas covering can be reduced to a minimum. At any rate, the arrangement is such that the annular high-pressure nozzle plane or the plane determined by the high-pressure nozzle ring is substantially horizontal in the pouring position.

The cover or covers preferably form with the tilting or swivel runner a closed, substantially gastight housing through which molten metal may flow. This interior is rendered inert by a suitable gas such as, for example, nitrogen.

According to a further form of the invention, particularly for cleaning or repair purposes the cover of the tilting or swivel runner is removable, the cover preferably being fastened on the tilting or swivel runner in such a way that it can be swivelled away, e.g. by means of a hinge.

If the point at which the molten metal is transferred from the transport runner into the inlet opening is located in a pit, the following solution presents itself particularly for retrofitting appropriate transfer points.

To repair or clean the swivel runner or tilting runners or to install a new transfer funnel, it is proposed according to a development of the invention that the housing of the transfer station comprising a stationary lower part and the cover be provided with a displaceable upper part, thereby helping to avoid extensive dismantling. This also avoids long periods of non-production which affect the productivity of the entire apparatus.

The upper part of the housing preferably comprises a framework having at least three wheels and a cover. Being able to move the upper part on wheels dispenses with the otherwise necessary use of lifting gear of the appropriate loading capacity and considerably minimizes the extent to which the use of cranes is required.

According to a development of the invention, the stationary lower part of the housing is disposed as the border of a pit and has lateral rails for two of the wheels of the framework of the upper part. The swivel or tilting runner and the transfer funnel are located in this pit. Owing to the movability of the upper part, i.e. the framework and the cover, it is no longer necessary for inspection work to provide one of the faces of the stationary lower part with swing-wing doors or similar closable openings. Access is effected after opening, i.e. moving, the cover by way of the border of the stationary lower part.

According to the described structure, it is possible to support the frame both on a three-point as well as a four-point bearing. However, to avoid long rails on both sides of the pit, the framework is preferably supported horizontally displaceably on three wheels of which two wheels run on the rails disposed laterally in the pit while the third wheel runs on a rail which is disposed parallel to and offset relative to the laterally disposed rails and leads to one face of the pit. This avoids a rail track of approximately the same length as the pit. To expose the pit and make the swivel runner and the transfer funnel accessible, the framework including the cover is suitably moved by sliding it away over the face of the pit. The space required to the side of the pit and the length of the third rail should be selected according to the length of the frame and of the pit.

For reasons of stability, the cover is preferably roof-shaped, i.e. substantially triangular in cross-section, and detachable from the frame.

The cover is also preferably provided with a sealing strip which closes the gap between the cover and the housing lower part. This substantially increases the tightness of the closed housing.

Slewing/lifting apparatus for the cover hoods

After installation of the transport and discharge runners, slewing/lifting apparatus is needed to enable the approximately 12 t cover hoods to be picked up from a sand bed and placed on the transport and discharge runners without damaging the blast furnace framework, i.e. safely guided. For this purpose, a slewing/lifting apparatus is proposed which has, disposed to one side of the tapping orifice and rotatable about its longitudinal axis, a vertical column with an outrigger on whose free end the lifting apparatus with a pick-up device for cover hoods is disposed.

To increase the mobility of the entire slewing/lifting apparatus, the pick-up device for the cover hoods is preferably designed to be rotatable relative to the lifting apparatus about a vertical axis. This may in particular be effected in that the pick-up device is connected by a ball bearing slewing rim to the lifting apparatus and is driven by a lantern gear.

The pick-up device preferably has fastening elements enabling the cover hoods to be deposited on and picked up from uneven ground, in particular a sand bed, in a moment-free manner. Shackles, for example, are suitable as fastening elements for this purpose.

The lifting apparatus should however have a stable-torque guide capable of absorbing unilateral moments of resistance in the event of uneven loading in order to avoid "tipping" of the cover hoods if, for example, these have skull-like deposits on one side.

According to a further development of the invention, the lifting apparatus can be raised and lowered by means of a cable, preferably a pulley block, with the cable guide preferably being resiliently supported by means of a cup spring arrangement at the fastening point (fixed point).

The rotatability of the vertical column is similarly brought about by means of a lantern drive gear. Copying mechanisms are preferably used to monitor momentary motional sequences or positions of the vertical column and/or lifting apparatus.

In the event that the lifting apparatus is permanently connected to the appropriate cover hood for the discharge runner at the tapping orifice, it is further recommended that an inert gas conduit be fastened by pipe turning knuckles to the lifting apparatus, with the free end of the conduit preferably having one part of a quick-release coupling for connection to the cover hood fitted with the corresponding part. If the cover hoods are to be cooled, it is recommended that a conduit be accordingly provided for conveying the cooling medium.

Embodiments of the invention are illustrated in the drawings.

Figure 2:
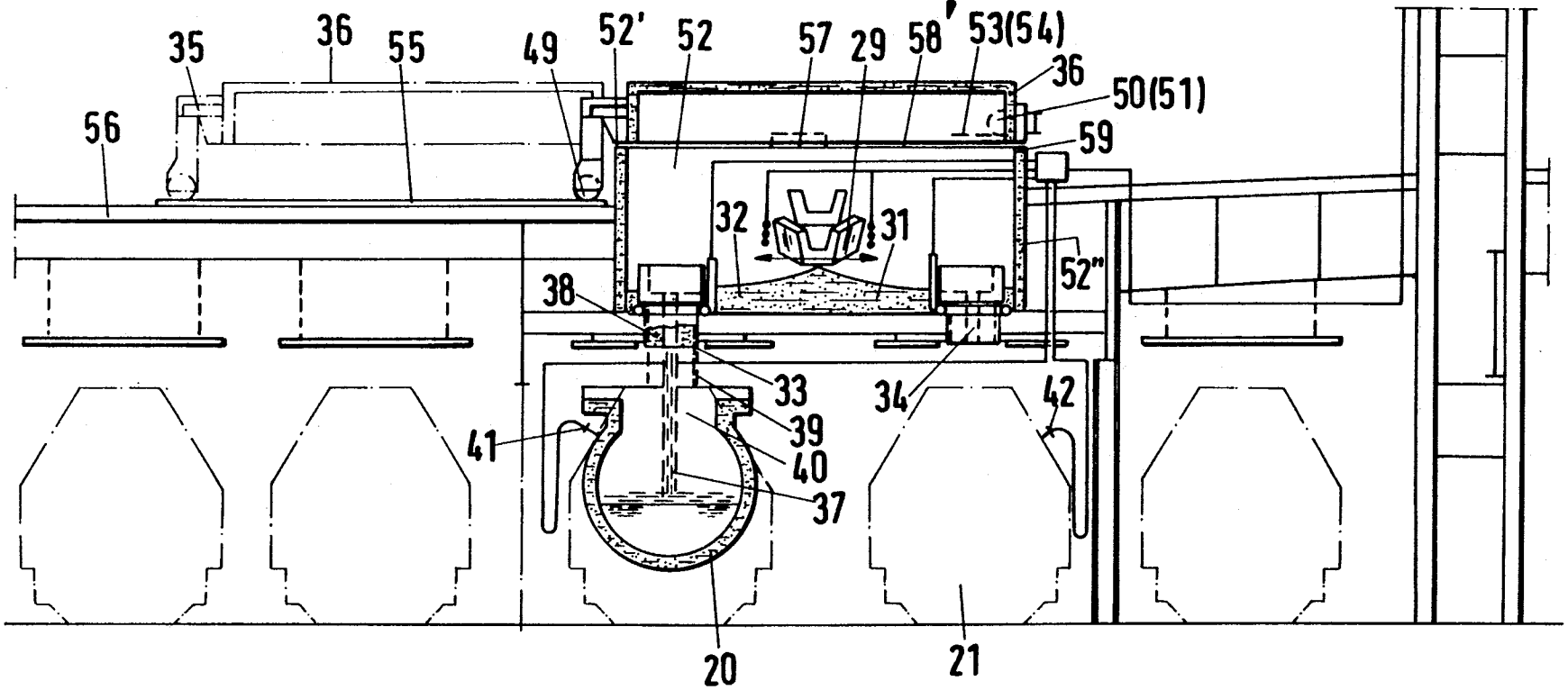
Figure 3:
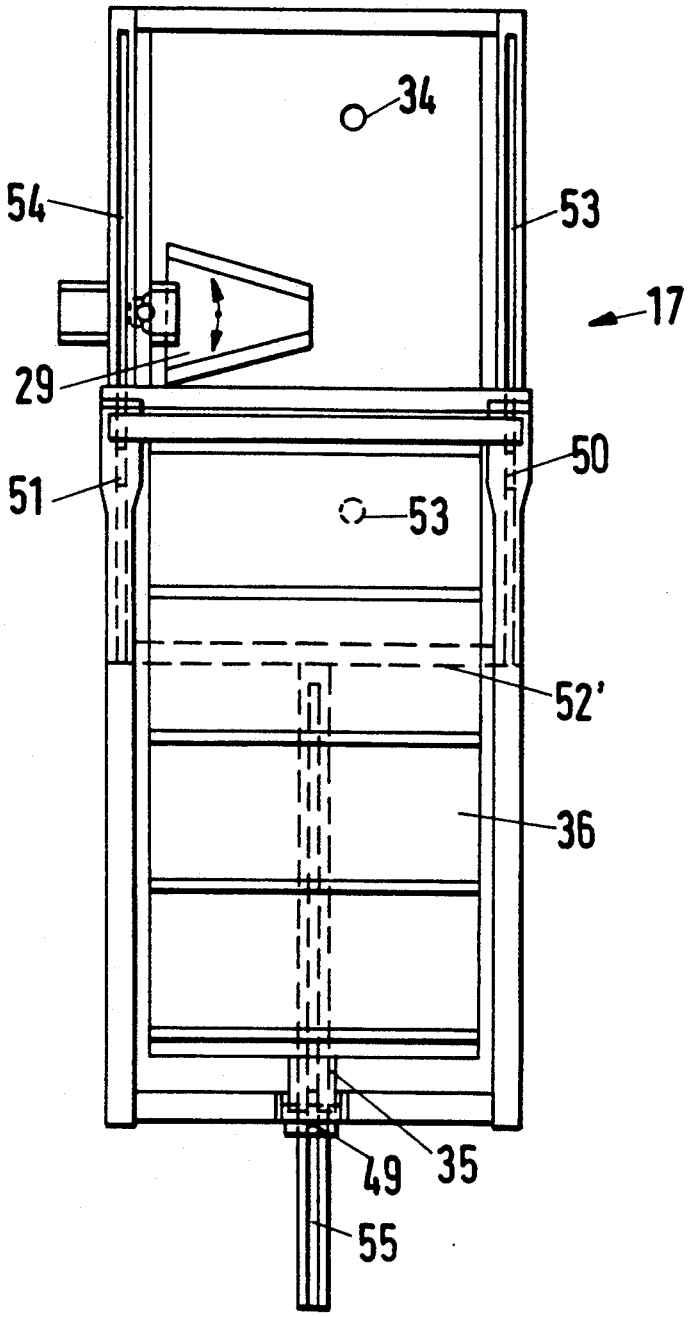

These show:

FIG. 1 a diagrammatic view of a blast furnace having three tapping orifices and a corresponding number of discharge runners leading to a transfer station, FIG. 2 a cross-sectional view along the longitudinal centre line of the pit with a movable upper part, FIG. 3 a plan view of the housing of FIG. 2 in half-open position.

Figure 4:
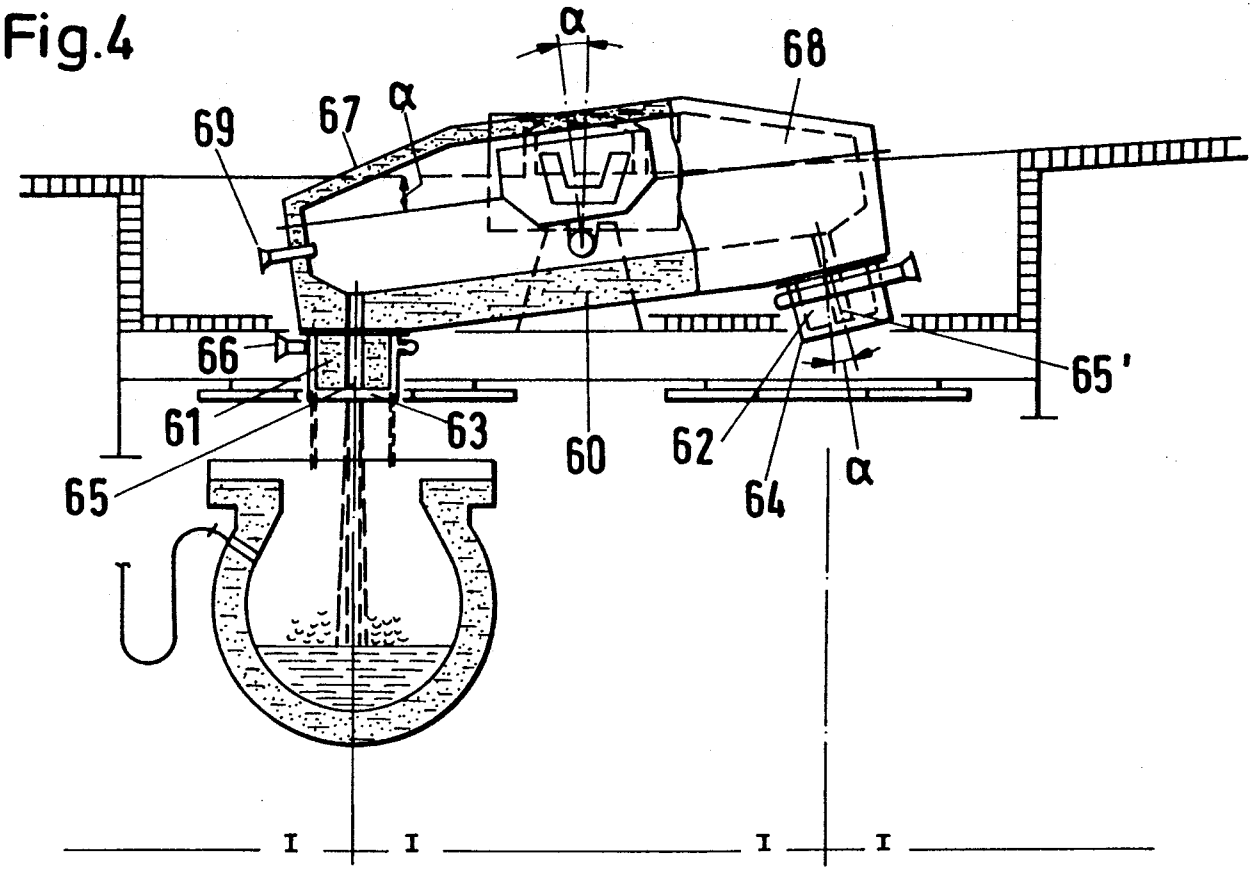
Figure 5:
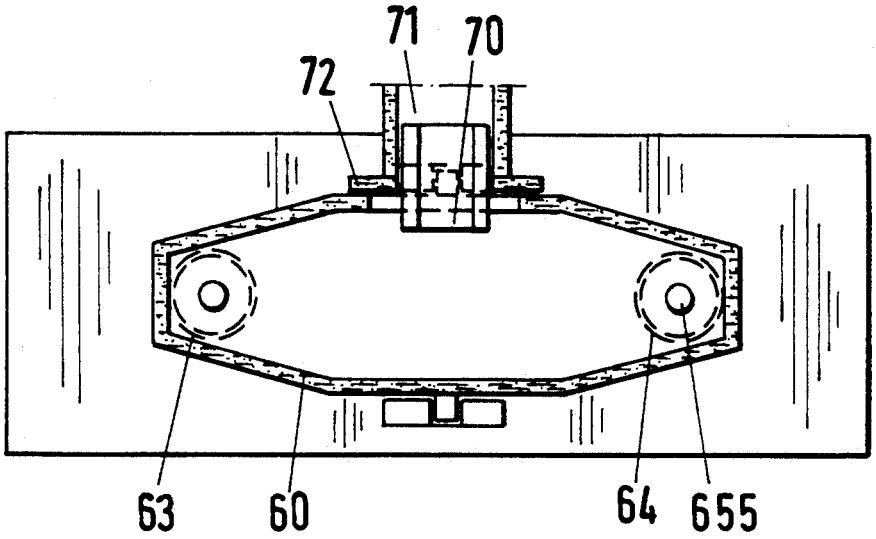
Figure 6:
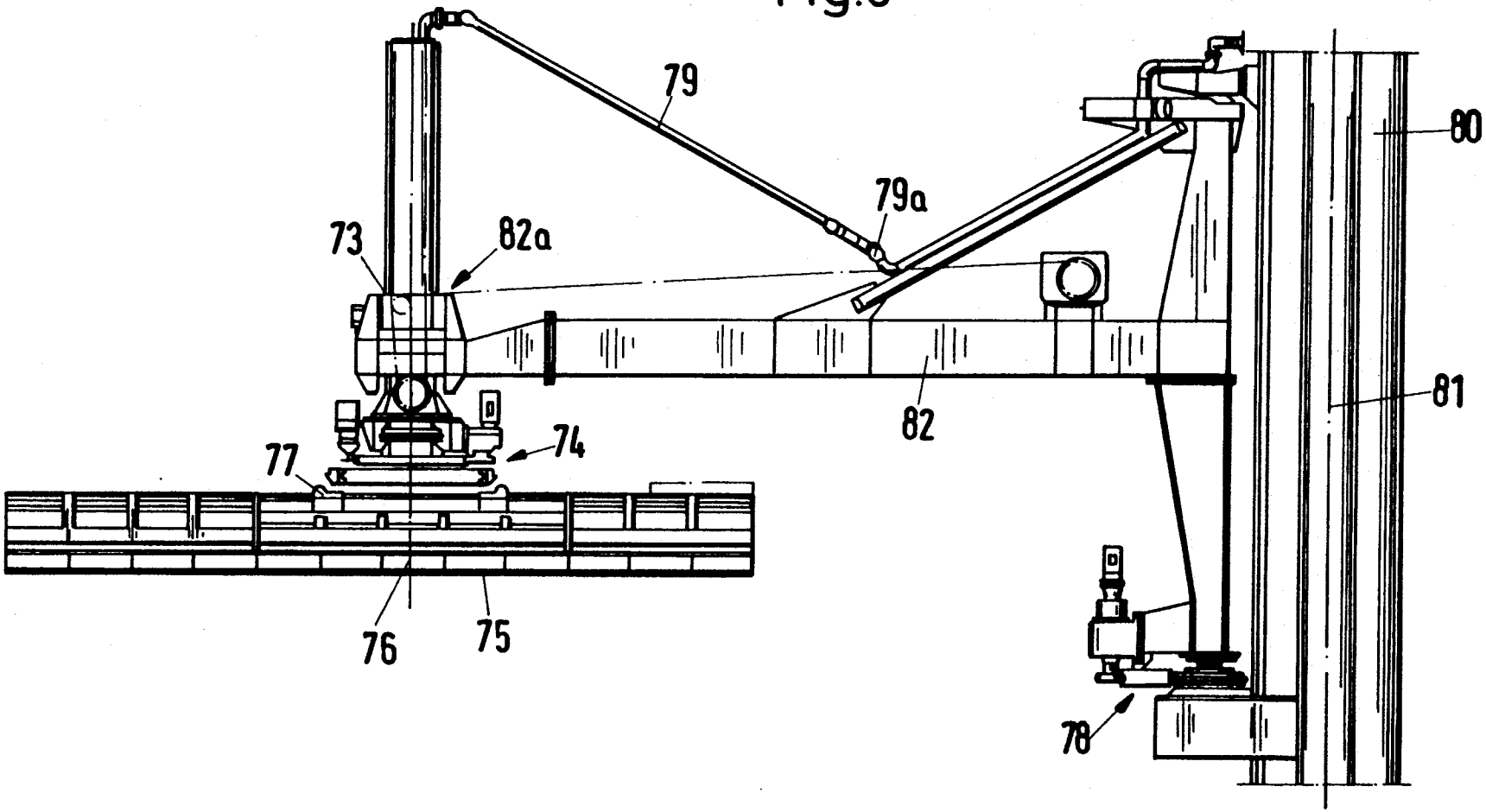

FIG. 4 a tilting runner in cross-section,

FIG. 5 a plan view of a tilting runner,

FIG. 6 a side view and

Figure 7:
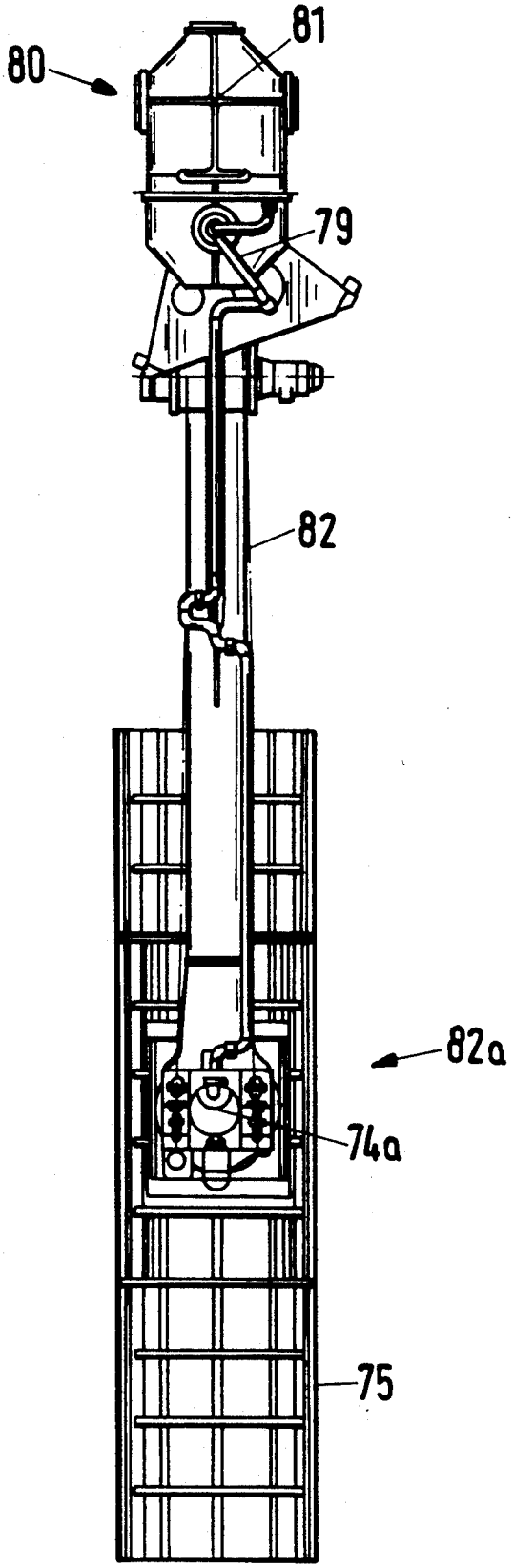

FIG. 7 a plan view of a slewing/lifting apparatus.

The blast furnace 10 illustrated in FIG. 1 has three tapping orifices 11, 12 and 13 from which discharge runners 14, 15 and 16 each lead to transfer stations 17, 18 and 19, below each of which movable casting vessels 20 and 21 (FIG. 2) are disposed to accept molten metal.

An essential feature of the apparatus according to the invention in the tapping area are the cover hoods 22, 23 and 24 which are acted upon by inert gas and are disposed in the region of their respective tapping orifice 11 to 13 in such a way as to be pivotable with the aid f the swivel devices 25, 26 and 27.

The pig iron is conveyed in each of the covered, inert discharge runners 14, 15 and 16 to the appropriate transfer stations 17, 18 and 19.

Inside the transfer stations 17, 18 and 19, the molten metal flows from the discharge runners preferably along swivel runners 28, 29 and 30 which are preferably laterally cooled by the inert gas flowing against them. The molten metal is preferably conveyed by way of distributing runners 31 and 32 (FIG. 2) to outlet openings 33 and 34 respectively. The transfer stations are entirely enclosed in housings 35 and 36; the roof construction 36, a more detailed description of which is given later, is horizontally movable.

The molten metal stream 37 emerges underneath the casting stage from the outlet opening 33 which is surrounded by the annular nozzle 8. This covers the molten metal stream with the inert gas veil 9 until it enters the upper opening 40 in the casting vessels 20 and 21.

Before and during charging, the interior of the casting vessel is acted upon by inert gas through preferably one or more inlet openings 41 and 42 located in the vessel's walls;

All the gas nozzles are connected to gas supply systems 43, 44, 45 and are supplied with nitrogen through pressure valves 46, 47 and 48.

The principle of the invention is similarly applicable to so-called tilting runners for which it is necessary preferably to enclose the tilting runner in a housing or cover it, details of which are given later, and to keep the housing interior under substantially inert conditions with a slight overpressure. The principle of the invention is equally applicable to slag transport runners.

The swivel runner 29 and the distributing runners 31 and 32 are located inside a pit 52 which is defined on both sides by rails 53 and 54. A third rail 55 is disposed parallel to said rails 53 and 54 and originating from the face 52' of the pit. The upper part comprising a framework 35 and a cover 36 is movably supported on said rails 53 to 55 by means of wheels 49 to 51. The rail 55 is set into the casting bay floor 56. The rails 53 and 54 are disposed on the lower part of the housing of the pit 52. The cover 36 is further provided with a sealing strip 57 which closes the gap 58 between the cover 36 and the stationary lower part 59.

If, instead of the swivel runners 28 to 30 which are surrounded by a closed housing 35 and 36, a tilting runner 60 as illustrated in FIGS. 4 and 5 is used, it is possible to dispense with the afore-mentioned housing. The tilting runner 60 has at its end outlet funnels 61 and 62 on the face of each of which is disposed a high pressure gas nozzle ring 63, 64. Provided that the tilting runner 60 must be tilted into the discharge position by being lowered by the angle $\alpha$, the discharge channel 65 with the channel longitudinal axis 655 is also disposed at the same angle $\alpha$ in relation to the tilting runner vertical. This means that the high-pressure nozzle ring 63 or 64 lies horizontally in the discharge position (see FIG. 4, lefthand side). The tilting runner 60 is covered by one or more covers 67 to form as small an interior 68 as possible. The covers 67 are detachably, preferably pivotably fastened on the tilting runner 60. To render the interior 68 above the surface of the molten metal (not shown) in the tilting runner inert, one or more inert gas nozzles 69 are provided on the underside of the cover. Like the high-pressure gas supply 66, the inert gas nozzles 69 may be supplied from a central control system.

The slewing/lifting apparatus shown in FIG. 6 and 7 basically comprises a vertically disposed column 80 which is rotatable about its longitudinal axis 81. This column is located to one side of the tapping orifice of a blast furnace (not shown). This column has an outrigger 82 on the free end **82*a* of which a lifting apparatus 73 is disposed which, in the present case, comprises a pulley block. The lifting apparatus is used to raise and lower a pick-up device 74 for a cover hood 75. This pick-up device 74 is connected to the lifting apparatus 73 by a ball bearing slewing rim 74*a* and is driven by a lantern gear. To allow the cover hoods 75 to be deposited on and picked up in a moment-free manner from the ground, for example comprising sand, shackles 77 are provided as fastening elements for the cover hood 75. The lifting apparatus 73 is moreover torque-stable so that, even in the eventuality that the cover hood has skull-like deposits on its side which substantially increase its weight there, the cover hood does not tip over. By means of the ball bearing slewing rim 74*a* and the lantern drive gear, the cover hood can be brought into any angular position in a horizontal plane (rotation about the vertical axis 76). A further possibility for rotation about the longitudinal axis 81 of the column is provided by means of the lantern drive gear 78 for the vertical column 80. Since a slewing/lifting apparatus is provided for each tapping orifice, it is finally recommended that the inert gas/cooling medium line be connected as a combined conduit 79 to the apparatus. This conduit 79 has pipe turning knuckles 79*a***.

We claim:

1. A method of preventing fume production when transporting molten metal from a metallurgical vessel to a casting vessel using transport means, comprising the steps of:

a) covering at least one of said metallurgical vessel and said transport means conveying the molten metal from a tapping orifice of the metallurgical furnace to form a free interior which is not filled with or flowed through by molten metal and has as small a volume as possible, b) screening a transfer point at which molten metal is passed from the transport means into a casting vessel in a substantially gastight manner, c) sweeping both the free interior of the transport means and the substantially gastight screened interior of the transfer point and the casting vessel interior with inert gas, and d) additionally screening the molten metal discharge stream from the tapping orifice to the casting vessel by a pressurized inert gas covering which prevents air access and is substantially annular in cross-section.

2. A method according to claim 1, including the step of cooling covers of at least one of the metallurgical vessel, the transport means, the screening of the transport means and/or of the swivel or tilting runner at the transfer point during through flow of the molten metal.

3. A method according to claim 2, wherein the inert gas is used as a cooling medium.

4. A method according to claim 1, wherein the annular inert gas covering is generated by an annular emission of inert gas under a pressure of 1.5 bar.

5. A method according to claim 1, wherein said inert is nitrogen or a gas whose free oxygen content has been removed by burning off in a combustion chamber and which has subsequently been cooled.

6. A method according to claim 1, including the step of adjusting the inert gas pressure in at least the metallurgical vessel and the transport means, at the transfer point and in the casting vessel interior, to between 10 and 100 Pa above the external pressure.

7. Apparatus for preventing fume production when molten metal flows along at least one transport runner installed at a tapping orifice of a metallurgical furnace, and a transfer station having a swivel or tilting runner in which the molten metal flows in use from the transport runner by way of a distribution system into outlet openings from which it flows off into a casting vessel, comprising a) cover hoods over a total length of each vessel and/or each transport runner which form(s) a free interior through which molten metal does not flow, which is as small as possible, b) means for screening off the transfer stations including the outlet openings in a substantially gastight manner, c) an annular high-pressure gas nozzle above the molten metal stream forming from the outlet opening to the inlet opening of the casting vessel, the inert gas flowing from which in line forms a vertical annular inert gas covering around the molten metal stream, and d) gas nozzles in the vessel, the cover hoods in the transfer station housing and in the casting vessel.

8. Apparatus according to claim 7, wherein the gas nozzles for each molten metal transport arrangement disposed downstream of a tapping orifice are connected to gas supply systems and the inert gas delivery of these systems is controllable by means of built-in pressure valves.

9. Apparatus according to claim 7, including means for swivelling the cover hoods clear of the transport runners.

10. Apparatus according to claim 7, wherein the transfer stations have movable covers.

11. Apparatus according to claim 7, wherein the transfer station including the outlet openings is substantially screened off by means of a closed housing.

12. Apparatus according to claim 11, wherein the closed housing of the transfer station is designed so that the tilting or swivel runner is covered over its total runner length by one or more covers to form a free interior through which molten metal does not flow, which is as small as possible, and the tilting or swivel runner has one or more outlet opening(s), and at outlet funnels has an annularly disposed high-pressure gas nozzle or a high-pressure gas nozzle ring.

13. Apparatus according to claim 12, wherein the outlet funnel and the annular nozzle or the high-pressure gas nozzle ring are disposed in such a way that the channel longitudinal axis of the outlet funnel and the inert gas surface area generated by the annular high-pressure gas nozzle or the high-pressure gas nozzle ring are substantially vertical in the pouring position.

14. Apparatus according to claim 12, wherein the free interior determined by the swivel or tilting runner and the cover(s) is sealed off from the outside in a substantially gastight manner.

15. Apparatus according to claim 14, wherein one or more nozzles for the admission of inert gas are disposed on the cover or on the tilting or swivel runner.

16. Apparatus according to claim 12, wherein the cover(s) is (are) fastened detachably on the swivel or tilting runner.

17. Apparatus according to claim 16, wherein the cover or covers is/are fastened on the swivel or tilting runner (6) in such a way that it/they can be swivelled clear.

18. Apparatus according to claim 12, wherein the outlet funnels are fastened detachably and exchangeably on the tilting runner.

19. Apparatus according to claim 12, wherein the transitions from the discharge runners to the movable tilting or swivel runners and their covers are provided with seals, preferably diaphragm seals or abradant seals.

20. Apparatus according to claim 7, wherein a substantially gastight housing of the transfer station comprising a stationary lower part a displaceable upper part including a cover.

21. Apparatus according to claim 20, wherein the upper part comprises a framework having at least three wheels and a said cover.

22. Apparatus according to claim 21, wherein the stationary lower part has rails for the wheels on its longitudinal sides.

23. Apparatus according to claim 22, wherein the framework is horizontally displaceable on three wheels, of which two wheels run on the two lateral rails of the stationary lower part, and the third wheel runs on a further rail which leads to a face of a pit and is disposed parallel to and offset relative to the laterally disposed rails.

24. Apparatus according to claim 21, wherein the cover is substantially roof-shaped in cross-section and is detachable from the framework.

25. Apparatus according to claim 20, wherein the cover is provided with a sealing strip which closes a gap between the cover and the stationary lower part.

26. Apparatus according to claim 7, wherein a vertical column disposed to one side of the tapping orifice and rotatable about its longitudinal axis has an outrigger on a free end of which a lifting apparatus having a pick-up device for cover hoods is disposed.

27. Apparatus according to claim 26, wherein the pick-up device is rotatable relative to the lifting apparatus about a vertical axis.

28. Apparatus according to claim 27, wherein the pick-up device is connected by a ball bearing slowing gear to the lifting apparatus.

29. Apparatus according to claim 27, wherein the pick-up device is drivable by means of a lantern gear.

30. Apparatus according to claim 29, wherein the pick-up device has fastening elements enabling the cover hoods to be deposited on and picked up from uneven ground in a moment-free manner.

31. Apparatus according to claim 30, wherein the fastening elements comprise shackles.

32. Apparatus according to claim 29, wherein the lifting apparatus has a stable-torque guide for absorbing unilateral moments of resistance in the event of uneven loading.

33. Apparatus according to claim 29, wherein the lifting apparatus can be raised and lowered by means of a cable, or tackle.

34. Apparatus according to claim 33, wherein the cable or tackle is resiliently supported by means of a cup spring arrangement at the fastening point.

35. Apparatus according to claim 29, wherein the vertical column is rotatably drivable by means of a lantern drive gear.

36. Apparatus according to claim 29, wherein copying mechanisms are provided for monitoring momentary motional sequences or positions of the vertical column and/or the lifting apparatus.

37. Apparatus according to claim 29, wherein an inert gas conduit and, if necessary, an additional cooling medium line, are fastened by pipe turning knuckles to the lifting apparatus.

* * * * *